US006079663A

United States Patent [19]

Slater

[11] Patent Number: 6,079,663

[45] Date of Patent: Jun. 27, 2000

[54] SPOOLED BARBWIRE DISPENSER

[76] Inventor: John E Slater, 19915 E. Altoona Rd., Altoona, Fla. 32702

[21] Appl. No.: 09/221,437

[22] Filed: Dec. 28, 1998

[51] Int. Cl.[7] ..... B65H 49/20

[52] U.S. Cl. ..... 242/588.2; 242/129

[58] Field of Search ..... 242/588.2, 588.1, 242/599.3, 597.7, 129, 130.2, 405.2, 405.3

[56] References Cited

U.S. PATENT DOCUMENTS

| | | | |
|---|---|---|---|
| 1,341,484 | 5/1920 | Starratt . | |
| 2,067,765 | 1/1937 | Juranic . | |
| 2,089,335 | 8/1937 | Brown . | |
| 3,815,842 | 6/1974 | Scrogin . | |
| 3,967,793 | 7/1976 | Walker . | |
| 3,974,980 | 8/1976 | Marcell | 242/129 |
| 4,167,255 | 9/1979 | Benson | 242/129 |
| 4,944,472 | 7/1990 | Stahl | 242/129 |
| 4,973,011 | 11/1990 | Wilson | 242/129 |
| 5,918,831 | 7/1999 | Floyd et al. | 242/130.2 |

FOREIGN PATENT DOCUMENTS

| | | | |
|---|---|---|---|
| 816029 | 7/1959 | United Kingdom | 242/130.2 |

*Primary Examiner*—John M. Jillions
*Attorney, Agent, or Firm*—Michael I. Kroll

[57] ABSTRACT

The present invention 10 discloses a swivel hook means 24 for grasping a spool of wire 14 being 360 degrees rotatable centrally mounted onto the underside of a rectangularly shaped metal plate 18 whereby the plate 18 further has a handle 20 for being grasped by the user 12 with the handle 20 being welded onto the top of the plate 18. The present invention 10 allows the swivel hook 24 to be hooked onto the handle 30 of a reel of wire 14 such as barbed wire 16, and further allows the reel of wire 14 to be unrolled so that the wire spool 14 is maintained effectively in the horizontal plane as the spool 14 is transported from one work location to the next.

6 Claims, 5 Drawing Sheets

SPOOLED BARBWIRE DISPENSER

BACKGROUND OF THE INVENTION

1. Field of the Invention

The present invention relates generally to a spooled wire dispenser and, more specifically, to a device having a handle attached to a plate which has a swivel hook centrally located within the plate providing means for attachment to a spool of barbed wire and after attaching one end of the wire to a fixed point the swivel hook provides means for the spool to turn on a horizontal plane while the spool is being carried to its next location.

2. Document Disclosure Program

The inventor of the present application, John E. Slater, has previously filed the present invention with the Document Disclosure Program of the U. S. Patent and Trademark Office, having No. 418, 910 dated May 1, 1997.

3. Description of the Prior Art

There are other dispensers designed to aid in uncoiling and unrolling spooled and rolled materials. Typical of these is U.S. Pat. No. 3,967,793 issued to Walker on Jul. 6, 1976.

Another patent was issued to Scrogin on Jun. 11, 1974 as U.S. Pat. No. 3,815,842. Yet another U.S. Pat. No. 2,089,335 was issued to Brown on Aug. 10, 1937. Still yet another U.S. Pat. No. 2,067,765 was issued to Juranic on Jan. 12, 1937 and yet another was issued to Starratt as U.S. Pat. No. 1,341,484 on May 25, 1920.

U.S. Pat. No. 3.967,793

Inventor: David O. Walker

Issued: Jul. 6, 1976

A wire spool holder, specifically adapted for barbed wire and the like includes freely rotatable spool engaging members and a freely rotatable holding or grasping member connected to the engaging members.

U.S. Pat. No. 3,815,842

Inventor: Willard D. Scrogin

Issued: Jun. 11, 1974

A reel for unreeling a coil of wire such as electricians wire which includes a guide, a support disk rotatably mounted on a central shaft and supported on a plurality of rollers positioned adjacent to the peripheral edge thereof. A set-screw brake is threaded into the hub of the support plate and engages against the vertical shaft to provide a braking action to prevent the reel from unwinding too fast. A plurality of posts are adjustably positioned on the reel base and supported thereabove to support the inner circular portion of a coil of wire to be unwound therefrom. The wire passes through a guide eye to help in maintaining the alignment thereof. A handle is secured to the upper end of the shaft for moving the reel from place to place.

U.S. Pat. No. 2,089,335

Inventor: G. L. Brown

Issued: Aug. 10, 1937

This United States Patent discloses a method for spooling barbed wire wherein all of the barbs project inwardly and for carrying purposes there is provided a stirrup or carrying frame the cross piece between the two arms serving as a handle.

U.S. Pat. No. 2,067,765

Inventor: Walter Juranic

Issued: Jan. 12, 1937

This United States Patent discloses a reel holding device which has the reel of material rotatably suspended so as to facilitate the discharge or unreeling of the material and when the device is not in use it may be collapsed to a compact form to occupy a minimum of space in storage.

U.S. Pat. No. 1,341,484

Inventor: Harold E. Starratt

Issued: May 25, 1920

This United States Patent discloses a single piece of resilient metal bent to form a grip member, a handle member having two straight portions adapted to lie parallel to each other, a pair of oppositely extending arms at the end of said handle portion, jaw members adjustably mounted on the ends of said arms, bearing members carried by said jaws members, means for securing the jaw members in their adjusted positions on the arms, and a keeper adapted to engage the portions of the handle member to draw the bearing members into a predetermined relation to each other.

While these spool dispensers may be suitable for the purposes for which they were designed, they would not be as suitable for the purposes of the present invention, as hereinafter described.

SUMMARY OF THE INVENTION

The present invention discloses a swivel hook means for grasping a spool of wire being 360 degrees rotatable centrally mounted onto the underside of a rectangularly shaped metal plate whereby the plate further has a handle for being grasped by the user with the handle being welded onto the top of the plate. The present invention allows the swivel hook to be hooked onto the handle of a reel of wire such as barbed wire, and further allows the reel of wire to be unrolled so that the wire spool is maintained effectively in the horizontal plane as the spool is transported from one work location to the next.

A primary object of the present invention is to provide an apparatus which can be used by one person to carry a spool of barbed wire and dispense said barbed wire while moving from one location to another.

Another object of the present invention is to provide a barbwire dispenser having a handle which will allow for easy handling of spools of barbwire.

Yet another object of the present invention is to provide said barbwire dispenser with means for attaching to a handle on a spool of barbwire.

Still yet another object of the present invention is to provide said barbwire dispenser with means for attaching to a handle on a spool of barbwire wherein said means will allow the spool of barbwire to rotate on a horizontal plane.

Additional objects of the present invention will appear as the description proceeds.

The present invention overcomes the shortcomings of the prior art by providing an apparatus which will attach to the handle of a spool of barbwire and allow an individual to carry the spool so that the apparatus provides means for rotating said spool of barbed wire on a horizontal plane while traveling from one location to another.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT(S)

Figure 1:
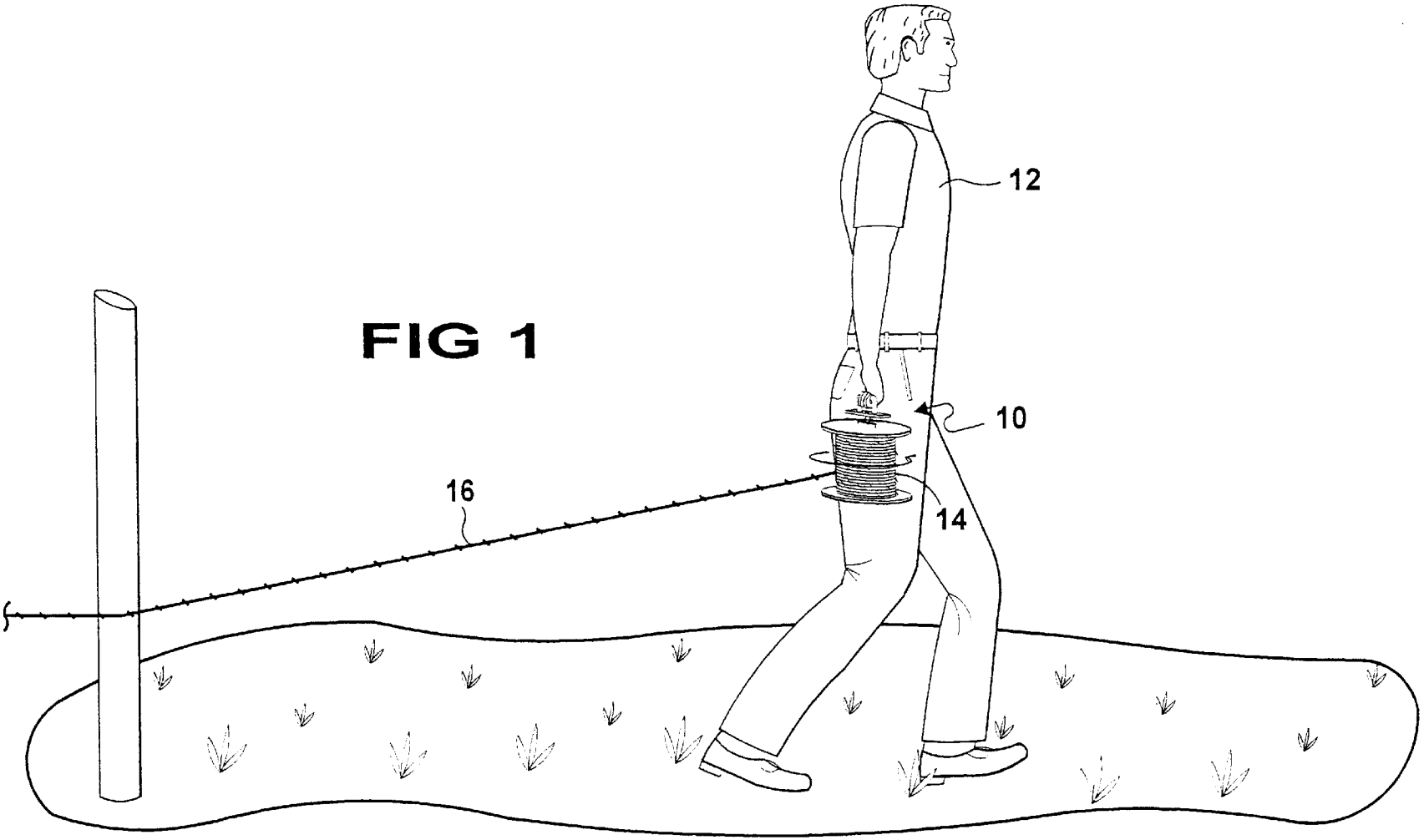
FIG. 1 is a perspective view of the present invention in use. Shown is the present invention attached to a spool of barbwire wherein the spool of barbwire is rotating on a horizontal plane as it is being carried from one location to another.

Turning now descriptively to the drawings, in which similar reference characters denote similar elements throughout the several views, FIGS. 1 through 5 illustrate the present invention being a device 10 for carrying a spool of wire 14. With regard to the reference numerals used, the following numbering is used throughout the various drawings.

10 present invention
12 user
14 spool of barbed wire
16 barbed wire
18 plate
20 handle
22 welding point
24 swivel hook
25 hook guard
26 central mounting means
28 swivel point
30 handle on reel of wire
32 mounting bolt
34 mounting nut
36 mounting hole Turning to FIG. 1, therein is shown the present invention, generally shown at 10, in use by a user 12. Shown is the present invention 10 attached to a reel or spool of barbed wire 14 wherein the spool of barbed wire is partially filled with barbed wire 16 for use in a work related environment. Shown is the spool of barbed wire 14 wherein the spool of barbed wire is rotating effectively in the horizontal plane and is being carried by the user 12 from one work location to the next.

Figure 2:
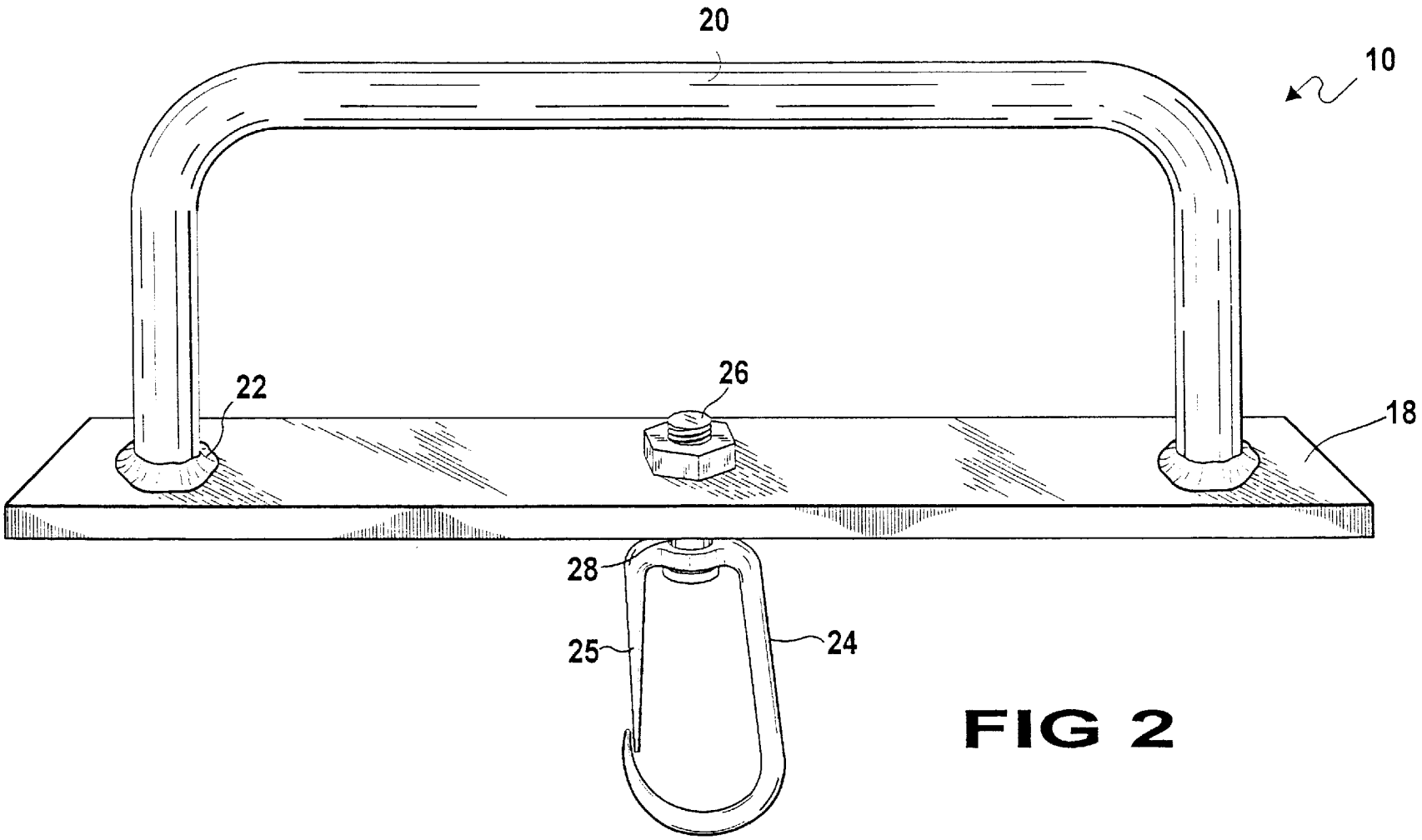
FIG. 2 is a perspective view of the present invention. Shown is a plate having a handle welded to the plate and a swivel hook centrally mounted to the plate.

Turning to FIG. 2, shown therein is a perspective view of the present invention 10 wherein is shown a plate 18 having a carrying handle 20 attached by welding at 22 to the upperside of the rectangular shaped plate 18. Also shown is a swivel hook 24 having a hook guard 25 centrally mounted by means 26 to the underside of the plate 18. Also shown therein is the swivel point 28 of the swivel hook 24.

Figure 3:
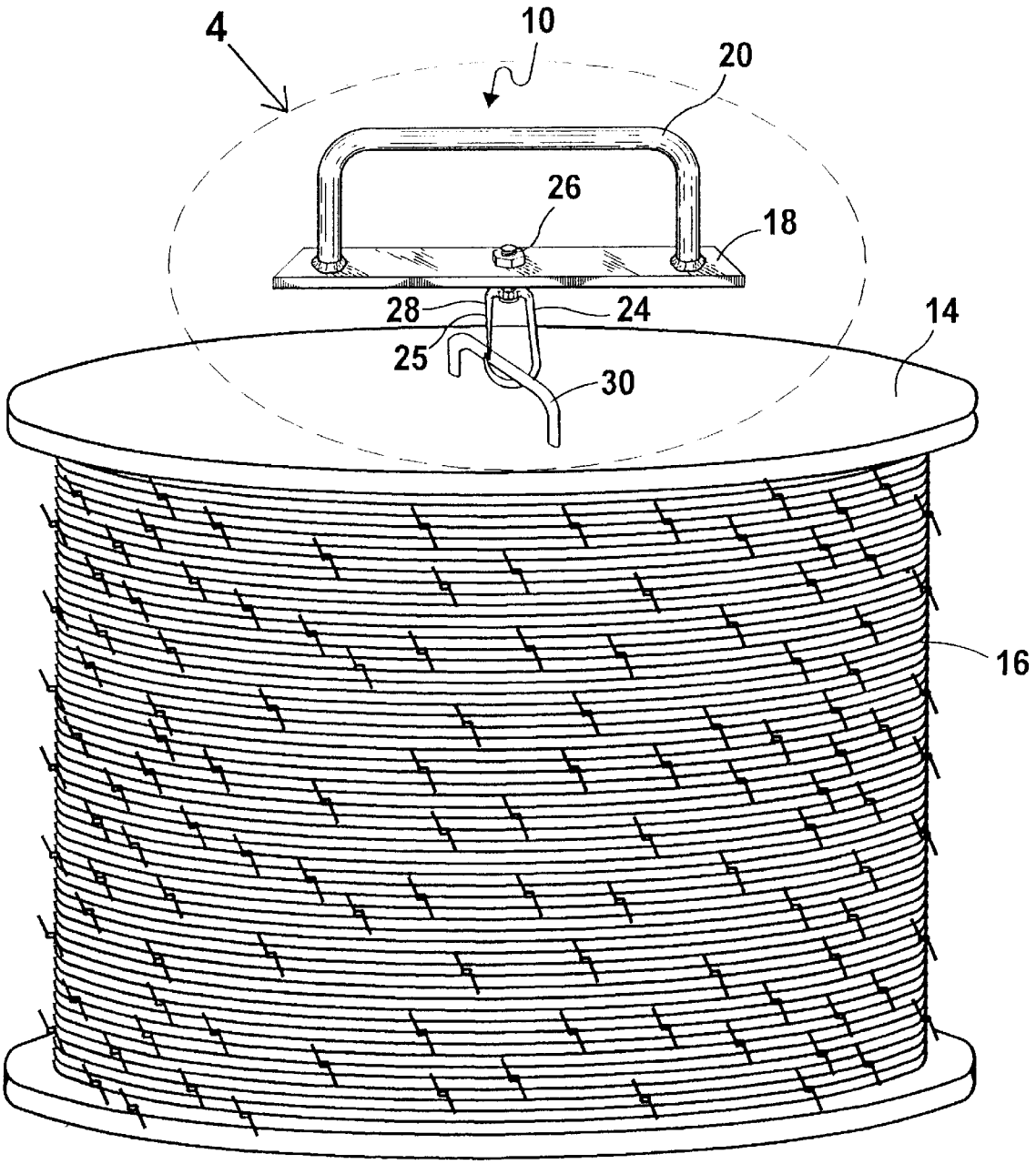
FIG. 3 is an enlarged view of the present invention attached to a spool of barbed wire.

Turning to FIG. 3, therein is shown an enlarged perspective view of the present invention 10 attached to a reel of barbed wire 14. A key element of the present invention 10 is the swivel hook 24 with hook guard 25 which is shown connected to the spool handle means 30 which is attached to the spool of barbed wire 14. As can be seen in FIG. 3, it is clear that the swivel hook 24 which rotates at its swivel point 28 is free to rotate about its connecting means 26 to the handle 20 so as to allow the reel of barbed wire 14 to rotate freely about a horizontal axis as the barbed wire is unwound from the reel 14.

Figure 4:
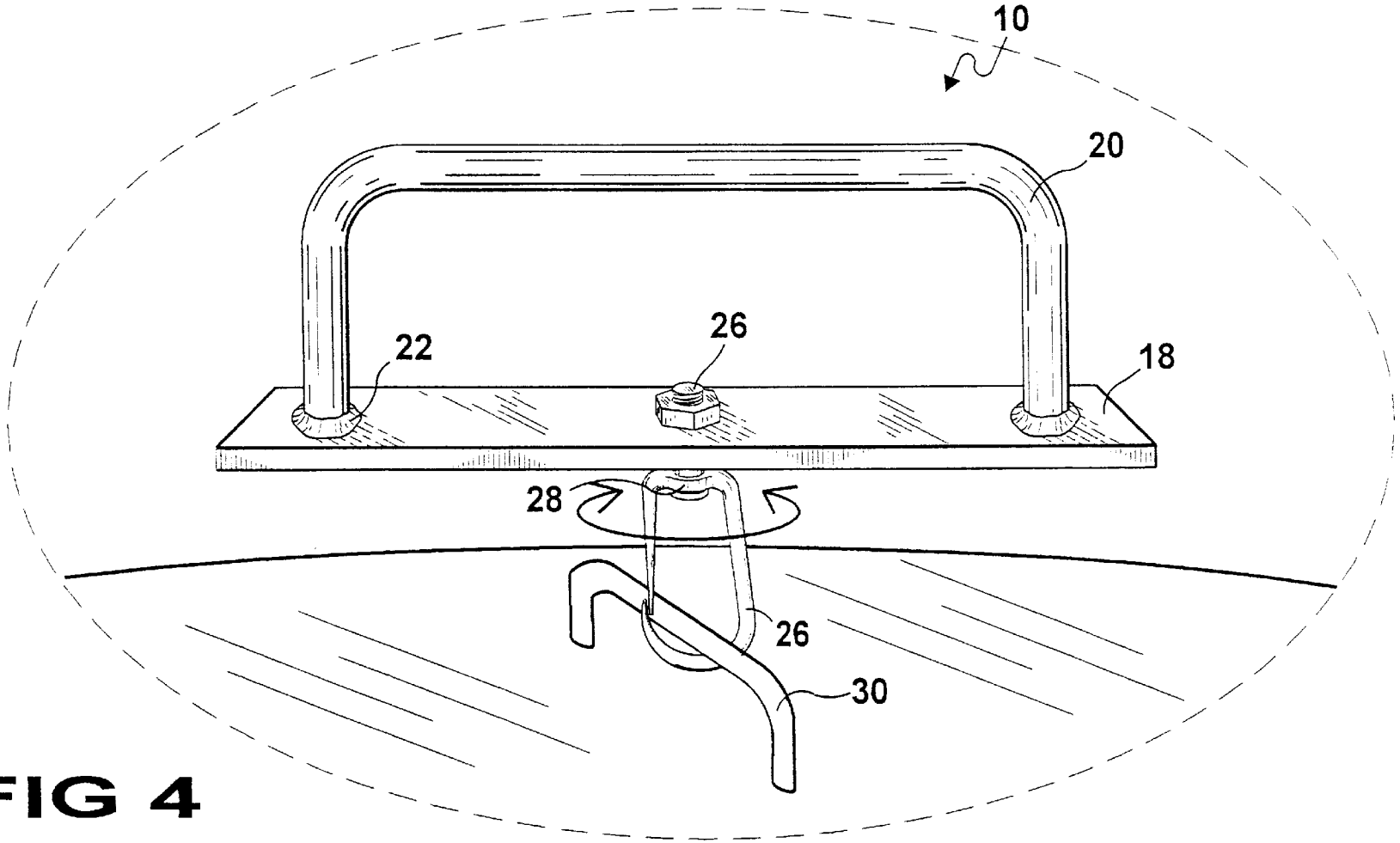
FIG. 4 is an enlarged perspective view of the present invention, taken from FIG. 3 as indicated showing the present invention attached to the handle of a spool of barbed wire and the 360 degrees of rotation possible using the invention.

Turning to FIG. 4, therein is shown an enlarged perspective view of the present invention taken from FIG. 3 as indicated showing the present invention 10 attached to the handle 30 of a spool or reel 14 of barbed wire. Shown is the handle 30 of the reel 14 of barbed wire attached to the swivel hook 24 of the present invention which is attached to the swivel point 28 of the present invention clearly showing the allowable 360 degrees of spool 14 rotation which is possible using the invention 10.

Figure 5:
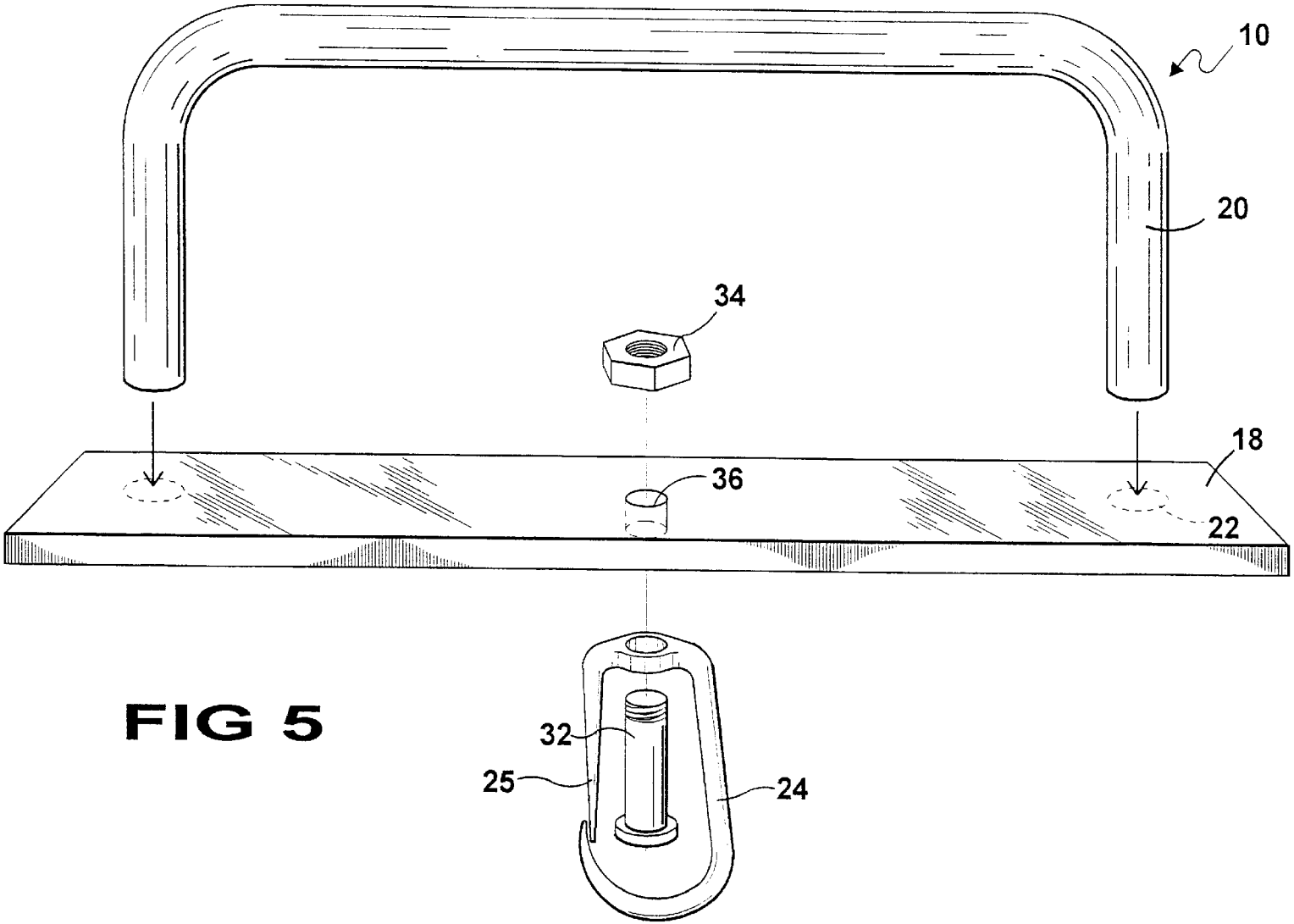
FIG. 5 is an exploded assembly view of the present invention showing the handle, base plate, hook, bolt and nut of the assembly.

Turning to FIG. 5, therein is shown an exploded view of the assembly of the present invention 10 showing the carrying handle 20, the rectangular shaped base plate 18, the swivel hook 24, the hook safety guard 25, the bolt 32 and nut 34 which holds the swivel hook 24 onto the base plate 18 having a mounting hole 36 therein through which the mounting bolt 32 passes in order to contact the mounting nut 34 and thereby tighten the bolt 32 and swivel hook 24 to the plate 18. Also shown is the handle 20 and the points where it is welded 22 to the plate 18.

What is claimed to be new and desired to be protected by Letters Patent is set forth in the claims:

1. A device for carrying a spool of wire, comprising:

(a) a handle being sized for use by humans;

(b) said handle having attachment means to the top of a rectangular plate;

(c) said plate having a swivel hook with means for mounting centrally on the underside of said plate for attachment to the spool of wire; and, (d) said swivel hook being attached to further attachment means on the spool of wire whereby the spool of wire can be carried.

2. The apparatus of claim 1, wherein said swivel hook has rotation means for rotating 360 degrees in the horizontal plane whereby wire can be freely unwound from the spool.

3. The apparatus of claim 1, wherein said handle attachment means further comprising being welded to said plate.

4. The apparatus of claim 1, wherein said swivel hook rotates about a bolt mounted to the underside of the plate using a mounting nut.

5. The apparatus of claim 1, wherein said swivel hook further comprises a hook guard having connecting means to said swivel hook.

6. The apparatus of claim 1, wherein said attachment means on the spool of wire further comprises a handle on the spool of wire whereby the spool of wire can be carried.

* * * * *